US006151054A

United States Patent [19]

Shimizu

[11] Patent Number: 6,151,054

[45] Date of Patent: Nov. 21, 2000

[54] THERMAL HEAD AND METHOD OF MANUFACTURING THE SAME, AND HEAT-SENSITIVE RECORDING METHOD

[75] Inventor: Osamu Shimizu, Shizuoka-ken, Japan

[73] Assignee: Fuji Photo Film Co., Ltd., Tokyo, Japan

[21] Appl. No.: 09/050,256

[22] Filed: Mar. 30, 1998

[30] Foreign Application Priority Data

Mar. 28, 1997 [JP] Japan ..... 9-078179

[51] Int. Cl.[7] ..... B41J 2/335

[52] U.S. Cl. ..... 347/204; 347/202; 347/200

[58] Field of Search ..... 347/200, 201, 347/202, 204; 29/611

[56] References Cited

U.S. PATENT DOCUMENTS 4,707,708 11/1987 Kitagishi et al. ..... 347/202

5,623,298 4/1997 Motoyama et al. ..... 347/202

FOREIGN PATENT DOCUMENTS 7-117359 5/1995 Japan ..... B41M 5/30

9-201992 8/1997 Japan ..... 347/202

*Primary Examiner*—Huan Tran

*Attorney, Agent, or Firm*—Sughrue, Mion, Zinn, Macpeak & Seas, PLLC

[57] ABSTRACT

A thermal head, used for an image forming device, comprises a glaze formed at at least a portion of a base plate of the thermal head so that at least a portion of the glaze is protruded, and a plurality of heater portions provided at the glaze, a length of each of the heater portions in a image forming direction of a recording material being less than or equal to 100 $\mu$m, wherein an outer surface of each of the heater portions is a convex curved surface and is the outermost portion of the glaze.

22 Claims, 8 Drawing Sheets

THERMAL HEAD AND METHOD OF MANUFACTURING THE SAME, AND HEAT-SENSITIVE RECORDING METHOD

BACKGROUND OF THE INVENTION

1. Field of the Invention

The present invention relates to a thermal head which is used for heat-sensitive recording, a method of manufacturing the same, a heat sensitive recording method, and more particularly to the improvement of a glaze for obtaining good image quality.

2. Description of the Related Art

As shown in FIG. 6, a thermal head 1 includes glaze 5 which are formed in the direction of a rotational central axis O of a platen 3. A recording material 7 is inserted between the platen 3 and the glaze 5, and the glaze 5 which corresponds to an image to be recorded on the recording material 7 is selectively heated. The image is thermally transferred onto an image receiving surface of the recording material 7 via a toner ribbon 6.

As shown in FIG. 7, in the glaze 5, a convex glaze layer 11 is formed on a ceramic base plate 9. A resistance heat generator 13, an electrode layer 15, a protective layer 17 are laminated onto the glaze layer 11. The electrode layer 15 is divided on the outer surface of the glaze layer 11 so as to form a pair of electrodes. The glaze 5 is constructed in such a way that, as the resistance heat generator 13 between the electrode layers 15 is heated, the glaze 5 performs records onto the recording material 7.

However, in the glaze 5 of the aforementioned conventional thermal head 1, because the electrode layer 15 is divided on the outer surface of the glaze layer 11 so as to secure the heat generating portion of the resistance heat generator 13, the outer surface of the protective layer 17 which is laminated last forms a depressed concave portion 19 due to the non-formation of the electrode layers 15. Namely, the heater portion 18 is formed inside the depressed concave portion 19, especially when the length of the heater portion in the image forming direction of the recording material is less than or equal to 100 $\mu$m. The contact between the outer surface of the heater portion 18 and the recording material 7 deteriorates, and there is a problem in that the image quality is adversely effected.

In order to solve this type of problem, as shown in FIG. 8, it was considered that the protruding portions 17*a* and 17*a* of the protective layer 17 could be removed by lapping, so that the outer surface of the heater portion 18 would form a flat surface, and the contact between the outer surface of the heater portion 18 and the recording material 7 would be improved. However, since the outer surface of the heater portion 18 formed a flat surface in this configuration, a new problem arose in that a detailed transfer of heat onto the recording material 7 could not be carried out, leading to the microscopic dot density distribution of a highlight portion not being uniform, and the sense of graininess from a macroscopic view increasing.

The present invention was developed in light of the above circumstances, and the object thereof is to provide a thermal head, a method of manufacturing the same, and a heat-sensitive recording method for improving the contact with a recording material and for decreasing the sense of graininess, thereby improving image quality.

SUMMARY OF THE INVENTION

In order to achieve the above-described object, the thermal head of the present invention has a structure comprising a glaze formed at at least a portion of a base plate of the thermal head so that at least a portion of the glaze is protruded, and a plurality of heater portions provided at the glaze, a length of each of the heater portions in a image forming direction of a recording material being less than or equal to 100 $\mu$m, wherein an outer surface of each of the heater portions is a convex curved surface and is the outermost portion of the glaze.

Namely, the thermal head of the present invention has a structure in which glaze is formed at a portion of the base plate of the thermal head so that the glaze is protruded.

Moreover, the thermal head of the present invention could have another structure in which the glaze is formed at substantially the entire base plate of the thermal head so that a portion of the glaze is protruded.

In a thermal head structured in this way, the outer surface of the heater portion protrudes to the outermost portion of the glaze. Compared to a conventional heater portion formed inside the concave portion, the outer surface of the heater portion can make better contact with a recording material. Further, because the outer surface of the heater portion is convex curved surface, a more detailed heat transfer can be carried out compared to the conventional flat outer surface of heater portion, and the image quality can be improved.

Further, in order to form a heater portion whose outer surface is a convex curved surface and is the outer most portion of the glaze, the outer surface of the glaze is lapped at two different positions in the image forming direction.

Moreover, the two different lapping positions are determined by changing the relative positions of the thermal head and a platen. The relative positions of the thermal head and the platen for determining one of the two different lapping positions is determined by disposing a spacer, which can change the relative positions of the thermal head and the platen, at the predetermined positioning portion. Consequently, one of the two different lapping positions can be easily determined.

Furthermore, the relative positions of the thermal head and the platen for determining the other of the two different lapping positions is substantially the same as the image forming position at which image forming is effected onto the recording material. Thus, the other of the two different lapping positions can be easily determined simply by removing the spacer from the predetermined positioning portion, so that the relative positions of the thermal head and the platen is returned to the position at which the image is formed on the recording material.

Alternatively, in order to form a heater portion whose outer surface is a convex curved surface and is the outer most portion of the glaze, a lapping tape is slid against the outer surface of the glaze in a forwards and backwards direction thereby lapping the outer surface of the glaze. Accordingly, the thermal head relating to the present invention can be manufactured.

Still further, when the thermal head structured in this way is used, a heat-sensitive transfer-recording material is provided. The heat-sensitive transfer-recording material has an ink layer whose film thickness is 1.0 $\mu$m or less, and further, includes a pigment having 30 to 70 parts by weight and an amorphous organic polymer having 25 to 60 parts by weight and a softening point of 40° C. to 150° C. The heat-sensitive transfer-recording material includes a substantially transparent heat-sensitive ink layer whose film thickness is within the range of 0.2 $\mu$m to 1.0 $\mu$m. The particle diameter of 70% or more of the pigment within the heat-sensitive ink layer is 1.0 $\mu$m or less and the optical reflection density of an image transferred onto a white supporting body is at least 1.0 or more. When recording is effected on such a heat-sensitive transfer-recording material, the image quality improves.

DESCRIPTION OF THE PREFERRED EMBODIMENTS

The preferred embodiments of a thermal head of the present invention will be explained in detail hereinafter with reference to the drawings.

Figure 1:
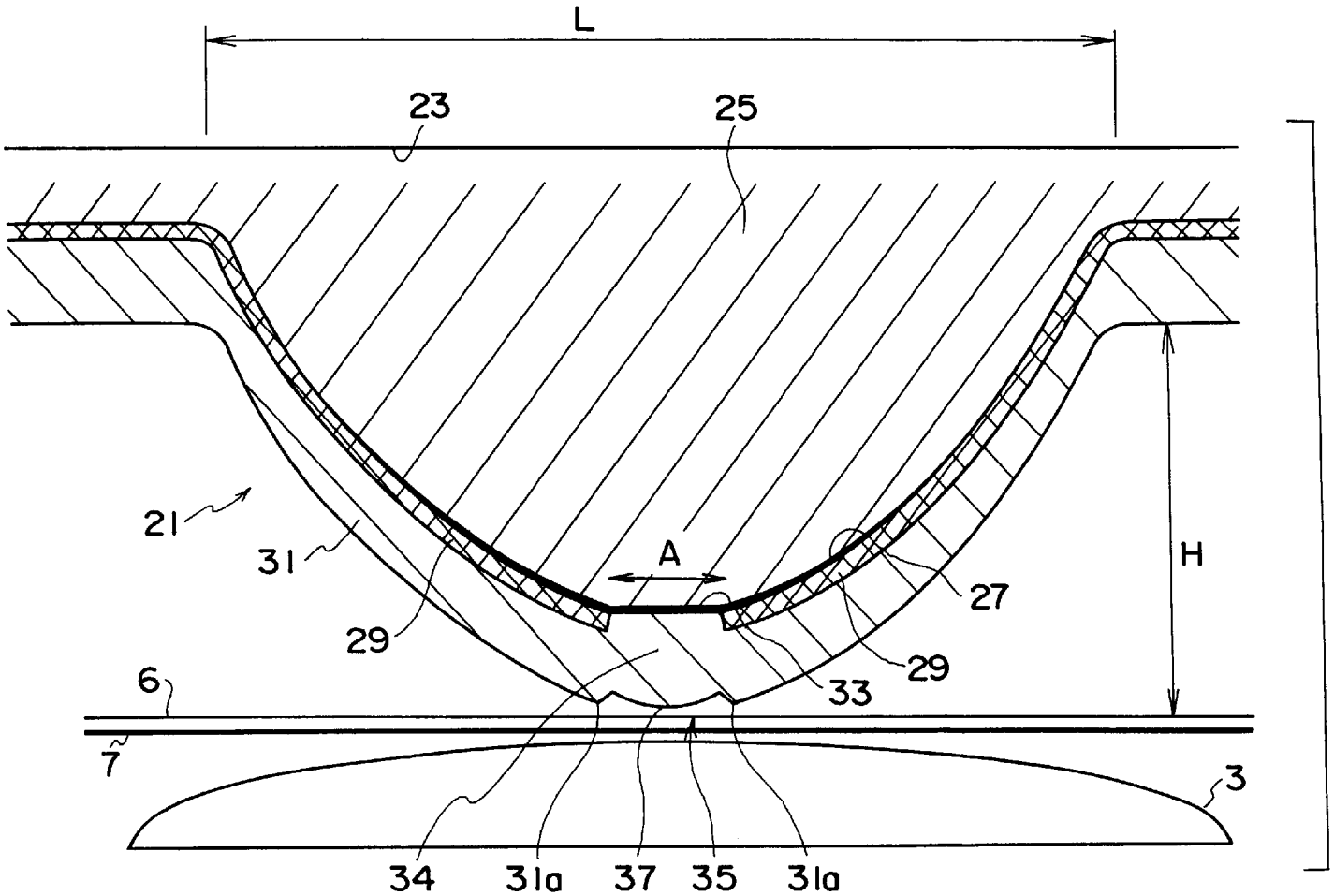
FIG. 1 is an enlarged view of a glaze of a thermal head according to the present invention.
Figure 6:
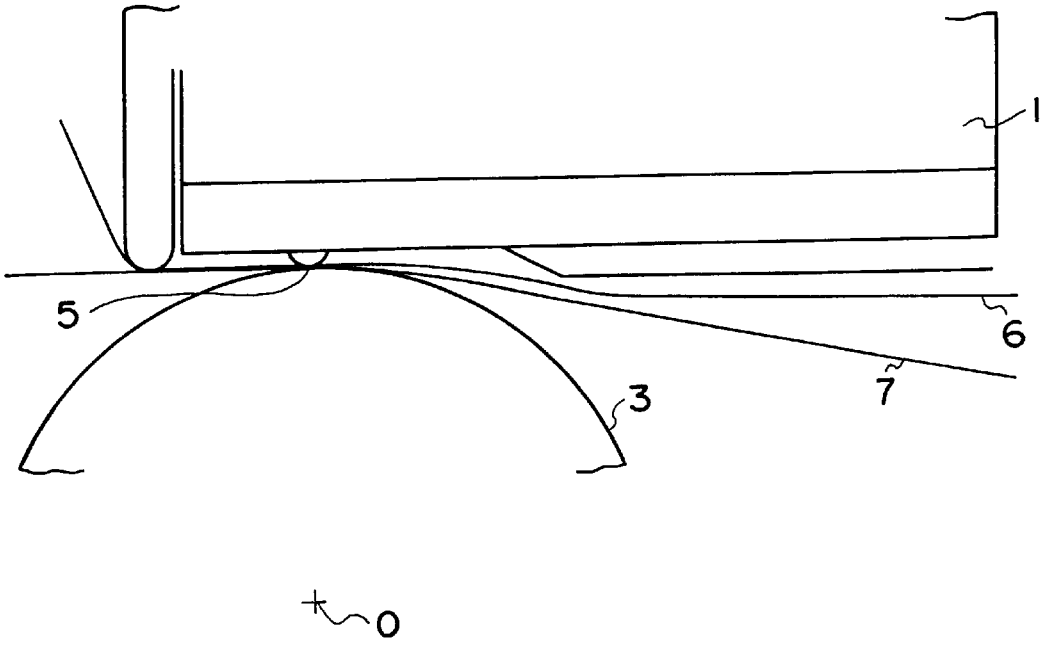
FIG. 6 is a side view which shows a conventional thermal head.
Figure 7:
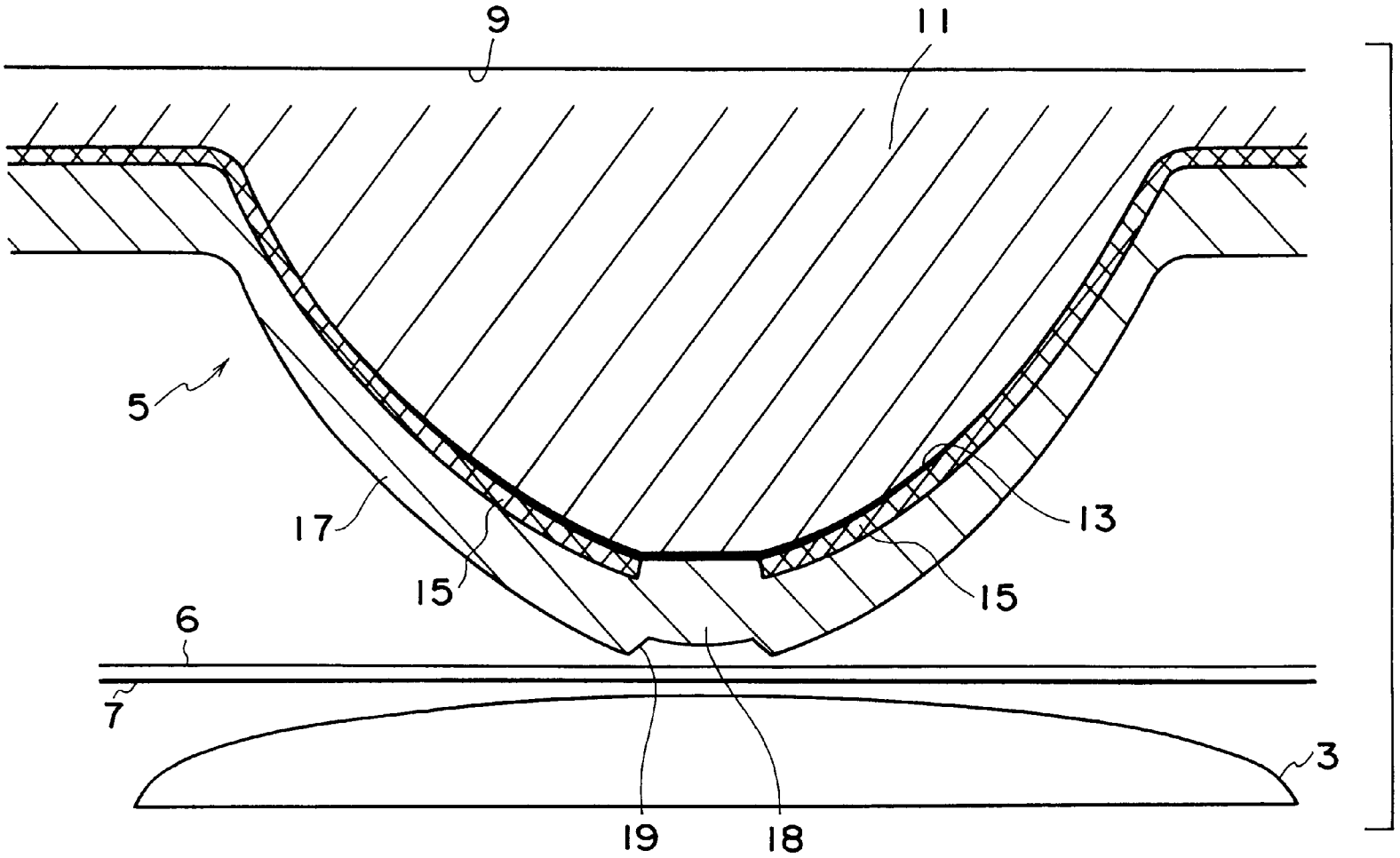
FIG. 7 is an enlarged cross-sectional view of a glaze provided at the conventional thermal head.
Figure 8:
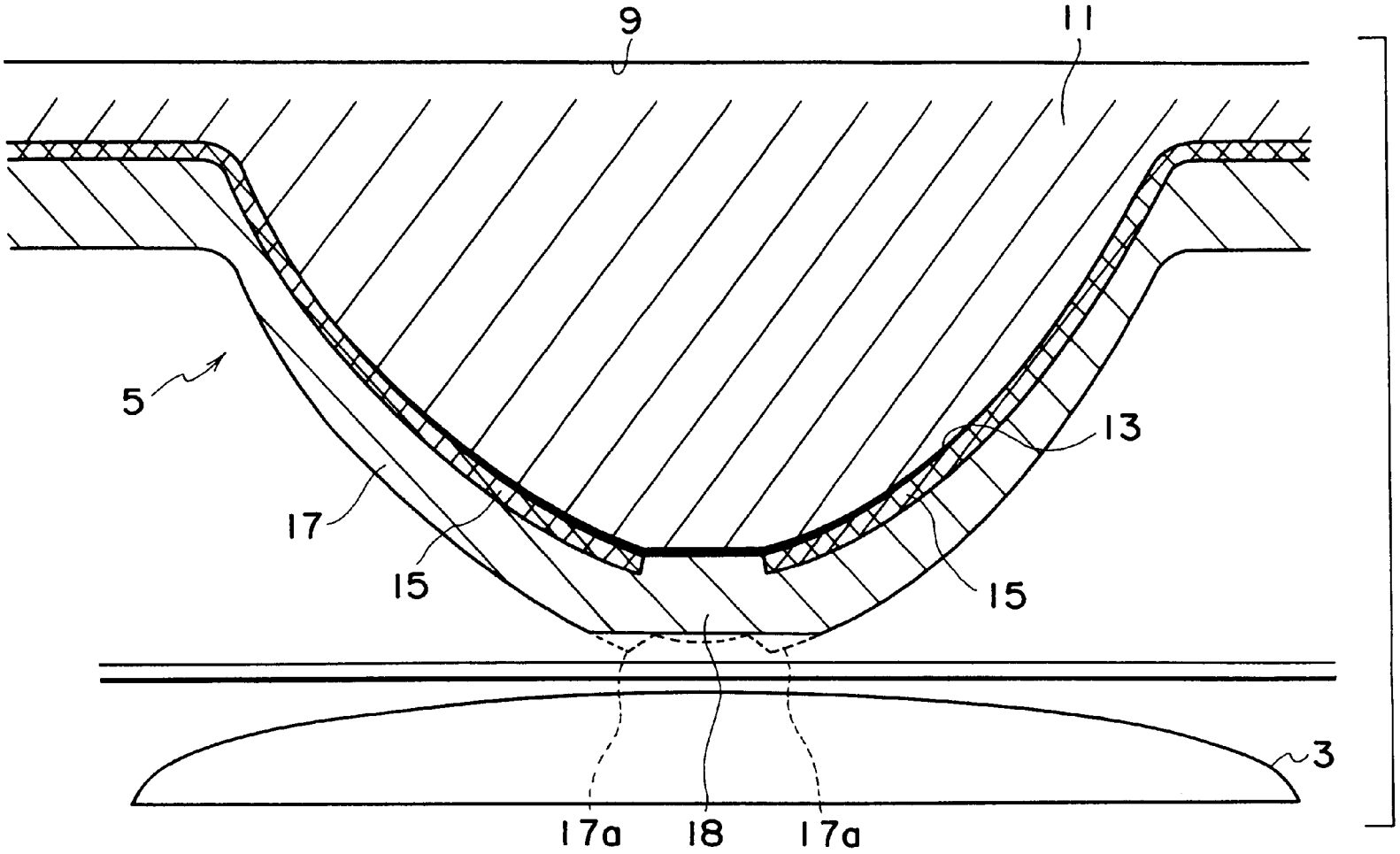
FIG. 8 is a cross-sectional view of the conventional glaze in which the outer surface is formed as a flat surface by lapping.

FIG. 1 is an enlarged view which shows a glaze of a thermal head according to the present invention. Members which are the same as those shown in FIG. 6 are denoted by the same reference numerals, and repetitive descriptions thereof are omitted. In the glaze 21 of the thermal head, a convex glaze layer 25 is formed on a ceramic base plate 23. A resistance heat generator 27, an electrode layer 29, and a protective layer 31 are laminated onto the glaze layer 25.

As in the same manner as the conventional example, the electrode layer 29 is divided on the convex outer surface so as to secure a heat generating portion 33. Voltage is applied to the electrode layer 29 to heat the heat generating portion 33. The outer surface of the heater portion 34 forms a convex curved surface 37. In the present embodiment, the curvature of the curved surface 37 is 0.04 $mm^{-1}$.

Further, two protruding portions 31*a* and 31*a* of the protective layer 31 are provided with the concave portion 35 therebetween, but the height of each of the protruding portions 31*a* and 31*a* is substantially the same as that of the outermost portion of the curved surface 37.

In the glaze 21 formed in this way, the outer surface of the heater portion 34 protrudes to the outermost portion of the glaze 21. Compared to the conventional heater portion formed inside the concave portion, the outer surface of the heater portion 34 makes better contact with the recording material 7.

Since the outer surface of the heater portion 34 is formed in the shape of a curve, compared to the conventional flat outer surface of heater portion, a more detailed heat transfer can be carried out onto the recording material 7, and the microscope dot density distribution of the highlight portions is more uniform.

In the present invention, the thermal head has a structure in which the glaze is formed at a portion of the base plate of the thermal head so that the glaze is protruded.

Also, the thermal head of the present invention could have another structure in which the glaze is formed at substantially the entire base plate of the thermal head so that a portion of the glaze is protruded.

As a method of forming the curved surface having a curvature of 0.04 $mm^{-1}$ or more, the protruding portions 31*a* and 31*a* are separately and successively lapped diagonally. Thereby, the curvature of the curved surface 37 can be made sharper. Moreover, the protruding portions may be removed by chemical etching or the like. Alternatively, a separate member may be added to the curved surface 37.

Figure 2:
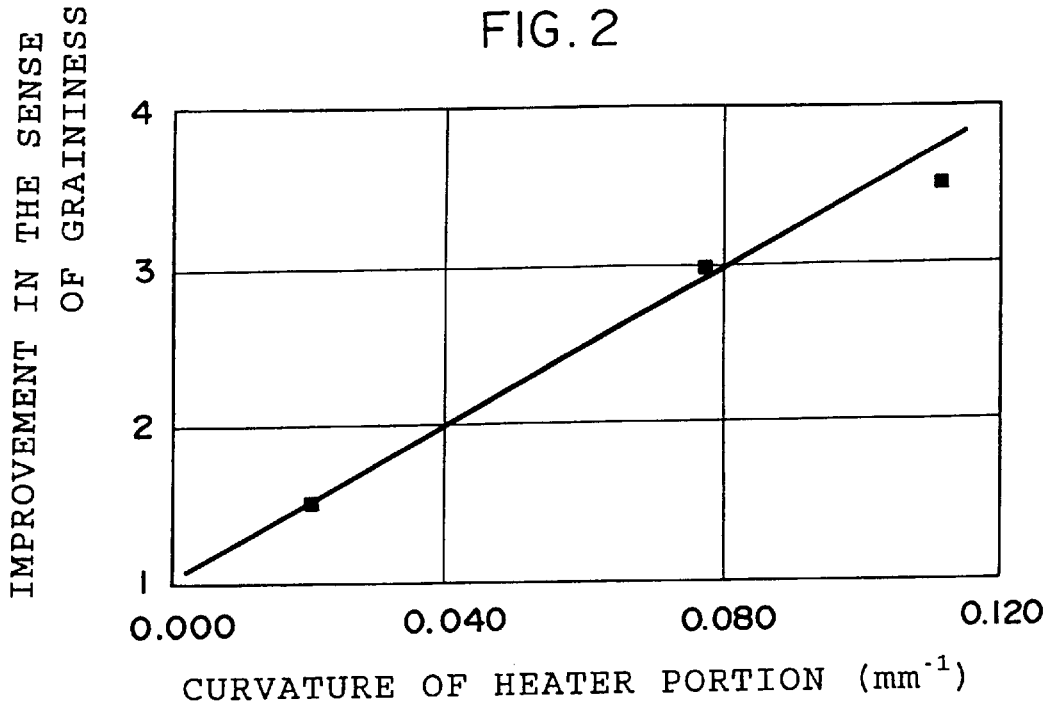
FIG. 2 is an explanatory view in which the relationship between the curvature of a heater portion and the improvement in the sense of graininess has been obtained by experiments.

FIG. 2 is an explanatory view in which the relationship between the curvature of the heater portion and the sense of graininess has been obtained by experiments. In FIG. 2, the improvement in the sense of graininess is on the axis of ordinates (the larger the numerical value, the less the sense of graininess) and the curvature ($mm^{-1}$) of the heater portion 34 is on the axis of abscissas.

The glaze 21 having the following dimensions was used as a glaze to be tested. The protruding height H of the glaze 21 is 50 $\mu$m; the length L of a base portion thereof is 1300 $\mu$m; the length A (the dimension in the image forming direction of the recording material) of the heater portion 34 is 80 $\mu$m; and the width of the glaze 21 (the dimension in the direction of a rotational axis O of the platen) is 75 $\mu$m.

From the results, it was found that the larger the curvature of the heater portion 34, the more the sense of graininess was decreasing. Moreover, if the manufacturability for making a profit on a commercial basis is considered, it was confirmed that the most appropriate curvature of the heater portion 34 be about 0.04 $mm^{-1}$.

The heater portion, whose outer surface is convex curved and is the outermost portion of the glaze, of the glaze of the present invention is obtained by lapping the protruding portions 31*a* and 31*a* of the glaze 21. The method of lapping the protruding portions of the glaze will be explained hereinafter with reference to FIG. 3.

Figure 3:
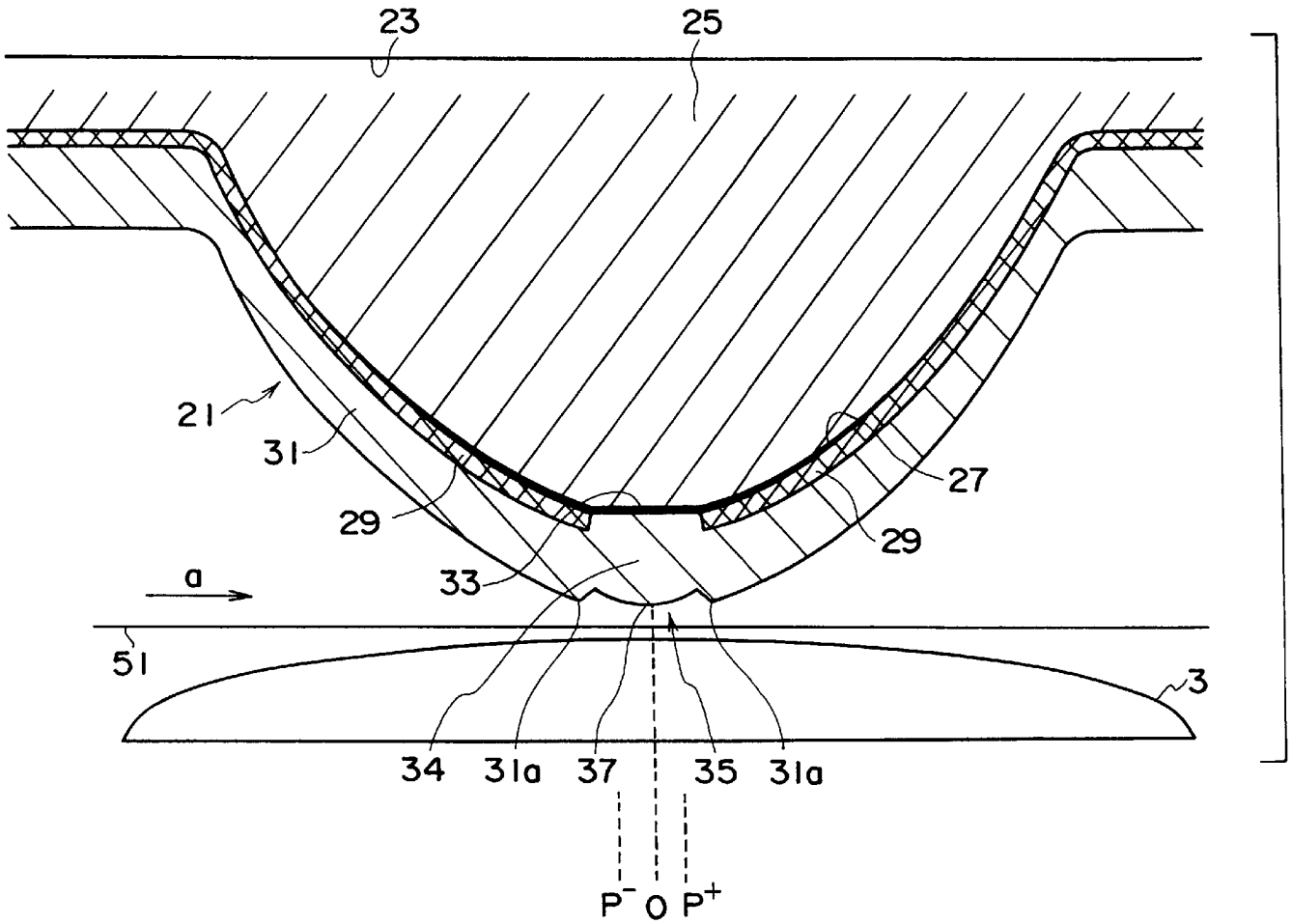
FIG. 3 is an explanatory view which shows the lapping of a outer surface of the glaze.

FIG. 3 shows a lapping method which uses an image forming mechanism. The outermost portion of the curved surface 37 of the glaze 21 contacts the platen 3 via a lapping tape 51 instead of an ink ribbon. In order to form the heater portion, whose outer surface is convex curved and is the outermost portion of the glaze, of the glaze of the present invention, the protruding portions 31*a* and 31*a* of the protective layer 31 are lapped.

On the basis of a position O (namely, an image forming position at which image forming is effected on the recording material) at which the outermost portion of the curved surface 37 contacts the platen 3, the platen 3 is moved to a position P+, which is shifted a predetermined distance in the moving direction a (forward direction) of the lapping tape 51, and to a position P−, which is shifted a predetermined distance in the direction (backward direction) opposite to the moving direction arrow a. At these positions P+ and P−, the lapping tape 51 is slid in the moving direction arrow a so as to lap the protruding portions 31*a* and 31*a*.

The moving distance of the platen 3, namely, the distance between the position O and the position P+ and the distance between the position O and the position P−, depends on the curvature of the outer surface of the glaze 21. In order to obtain the curvature of 0.04 $mm^{-1}$, it suffices if the forward direction moving distance is 300 $\mu$m and the backward direction moving distance is 500 $\mu$m.

In the present embodiment, the platen is moved, however, it is obvious that the thermal head may be moved provided that the relationship between the relative positions of the thermal head and the platen is changed.

Moreover, one of the two different lapping positions may be the position O. Namely, the two different lapping positions may be O and the other lapping position may be another position.

In FIG. 3, the outer surface of the glaze is lapped at the two different positions P+ and P− in the sliding direction a of the lapping tape 51. However, the outer surface of the glaze may be lapped at the same position O and lapping tape is slid in the forward and backward directions.

If the lapping tape is slid at the position O in the forward and backward directions, the lapping position at the time of sliding in the forward direction and the lapping position at the time of sliding in the backward direction is changed. Accordingly, the obtained result is similar to that obtained when the outer surface of the glaze is lapped at the two different positions in the same sliding directions.

In this case, as shown in FIG. 3, because the outer surface of the glaze can be lapped without changing the relationship between the relative positions of the platen and the thermal head, it is easy to carry out the lapping operation.

When the outer surface of the glaze is lapped, the lapping positions can be correctly determined by using the aforementioned image forming mechanism. Additionally, because the lapping can take place under predetermined conditions, the precision of the lapping improves.

Next, a description will be given of a case in which a thermal head is moved from the position O to the position P+ on the basis of FIGS. 4 and 5.

Figure 4:
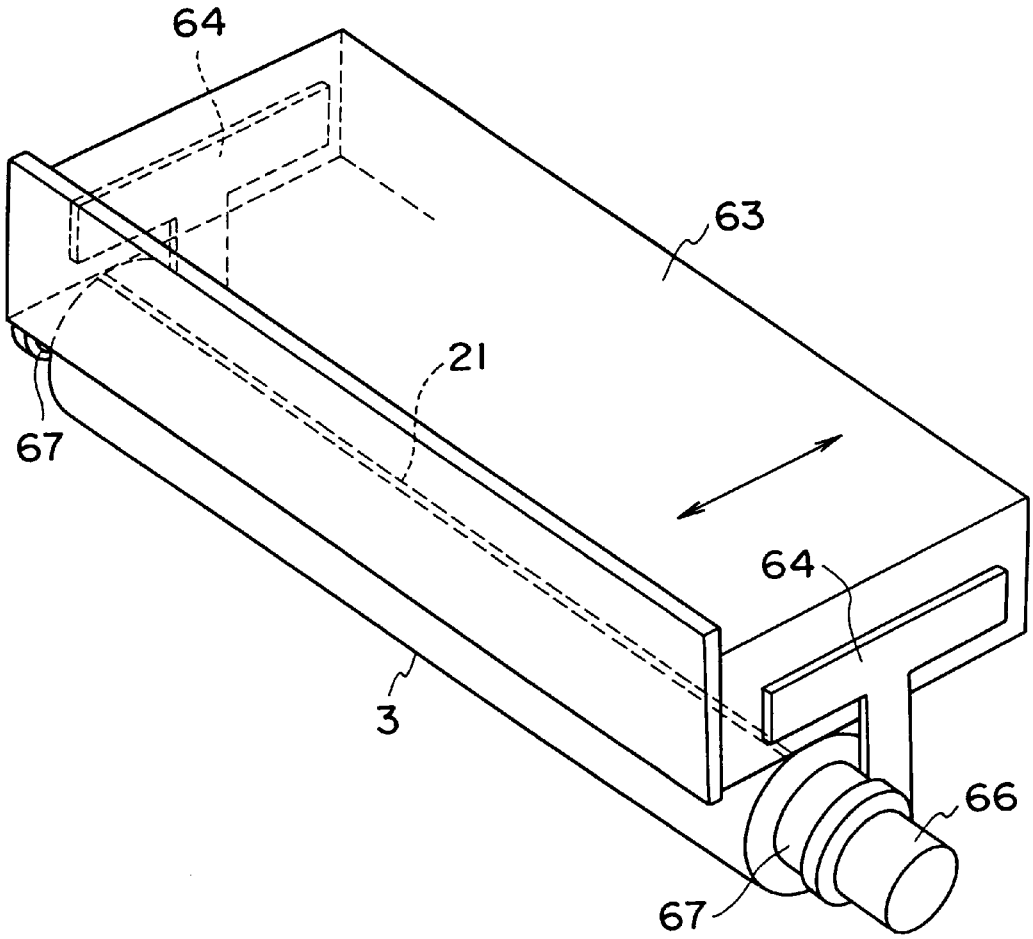
FIG. 4 is a perspective view which shows a state in which a sub-frame having a thermal head according to the present invention is disposed at a image forming position.

FIG. 4 is a perspective view which shows a state in which a sub-frame, which includes a thermal head and which can be disposed at a image forming position and disposed at a position other than the image forming position, is disposed at a image forming position and which shows the relationship between the positions of the platen 3 and a thermal head 63.

The thermal head 63 is a substantially rectangular member, and the platen 3 is disposed below the thermal head 63. The platen 3 is a pipe-shaped member and is rotatably mounted on a main frame 61 (see FIG. 5) via a platen shaft 66 (only the right side is illustrated) which protrudes from both ends of the platen 3. A bearing 67 is attached to the end of the platen shaft 66.

The thermal head 63 includes a glaze 21 which is provided at the underside thereof and parallel to the platen 3. As shown in FIG. 3, the outermost portion of the curved surface 37 of the glaze 21 contacts the platen 3 at the contact position O (i.e., the image forming position). The recording material 7 (see FIG. 6) is inserted between the platen 3 and the glaze 21, and the part of the glaze 21 which corresponds to the image to be formed onto the recording material 7 is selectively heated. Accordingly, the image is thermally transferred onto the image receiving surface of the recording material 7 via the toner ribbon 6 shown in FIG. 6.

Figure 5A:
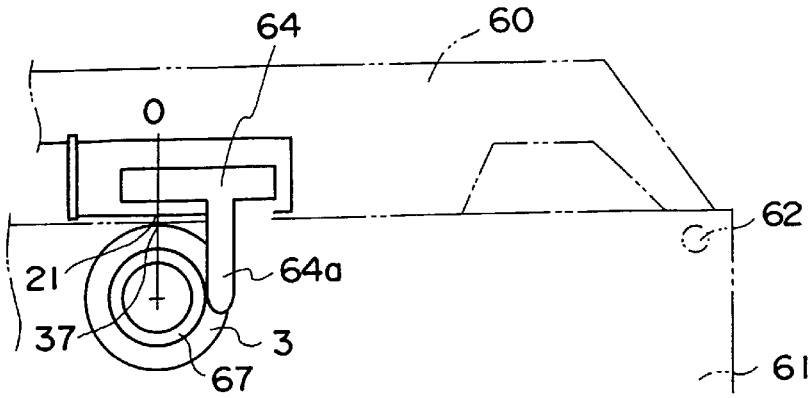
FIG. 5A is an explanatory view in which the glaze of the thermal head is moved to a lapping position.
Figure 5B:
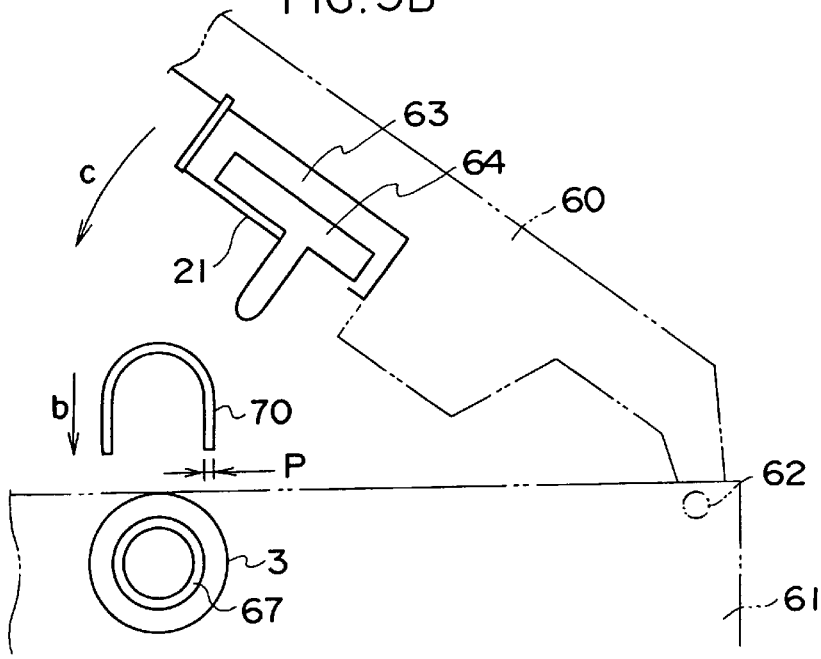
FIG. 5B is an explanatory view in which the glaze of the thermal head is moved to the lapping position.
Figure 5C:
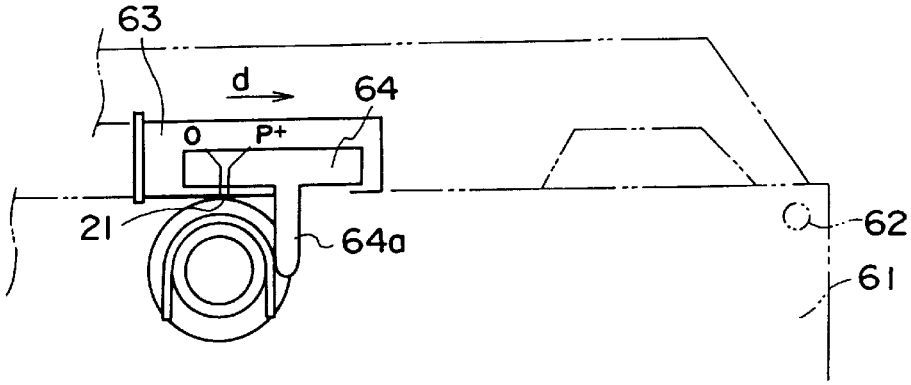
FIG. 5C is an explanatory view in which the glaze of the thermal head is moved to the lapping position.

FIG. 5A, 5B, 5C are explanatory view which shows a state in which the glaze of the thermal head according to the present invention is moved from the image forming position O to the lapping position P+ (see FIG. 3).

The thermal head 63 is provided at the sub-frame 60. The sub-frame 60 is supported at the main frame 61 by a shaft 62 serving as a supporting point so that the sub-frame 60 can be disposed at an image forming position and disposed at a position other than the image forming position. The thermal head 63 is supported at the sub-frame 60 so as to be movable in the direction of arrow d and a head supporting member 64 is provided at each end of the thermal head 63.

FIG. 5A shows a state (see FIG. 3) in which a leg portion 64*a* of the head supporting member 64 contacts the bearing 67 and the outermost portion of the curved surface 37 of the glaze 21 contacts the platen 3 at the contact position O, i.e., a state in which the glaze 21 is disposed at the image forming position.

In FIG. 5B, the sub-frame 60 is disposed at the position other than the image forming position around a shaft 62 serving as a supporting point, the glaze 21 of the thermal head 63 is separated from the platen 3, and thereafter, a substantially U-shaped spacer 70 is inserted into the bearing 67 of the platen 3 in the direction of arrow b. The thickness of the spacer 70 is set to p. Next, the sub-frame 60 is moved around the shaft 62 serving as a supporting point and the thermal head 63 is moved in the direction of arrow c.

In FIG. 5C, the leg portion 64*a* of the head supporting member 64 contacts the spacer 70, and the thermal head 63 is moved by the thickness p of the spacer 70 in the direction of arrow d. As a result, the glaze 21 of the thermal head can be moved from the position O to the position P+ (see FIG. 3). In this state, as shown in FIG. 3, the lapping tape 51 is slid in the moving direction arrow a so as to lap the protruding portions 31*a* and 31*a*.

In this way, because the thermal head 63 can be moved from the position O to the position P+simply by inserting the spacer 70 into the bearing 67, the glaze 21 of the thermal head 63 can be easily moved to the lapping position, and simply by removing the spacer 70 from the bearing 67, the glaze 21 of the thermal head 63 can be easily returned to the original printing position.

When the thermal head structured in this way is used, a heat-sensitive transfer-recording material is provided. The heat-sensitive transfer-recording material has an ink layer whose film thickness is 1.0 $\mu$m or less, and further, includes a pigment having 30 to 70 parts by weight and an amorphous organic polymer having 25 to 60 parts by weight and a softening point of 40° C. to 150° C., in accordance with Japanese Patent Application Laid-Open (JP-A) No. 7-117359. The heat-sensitive transfer-recording material includes a substantially transparent heat-sensitive ink layer whose film thickness is within the range of 0.2 $\mu$m to 1.0 $\mu$m. The particle diameter of 70% or more of the pigment within the heat-sensitive ink layer is 1.0 $\mu$m or less and the optical reflection density of an image transferred onto a white supporting body is at least 1.0 or more. When recording is effected on such a heat-sensitive transferrecording material, the image quality improves.

What is claimed is:

1. A thermal head used for an image forming device, comprising:

a glaze formed at at least a portion of a base plate of the thermal head so that at least a portion of said glaze is protruded; and a plurality of heater portions provided at said glaze, a length of each of said heater portions in a image forming direction of a recording material being less than or equal to 100 $\mu$m, wherein an outer surface of each of said heater portions is a convex curved surface and is the outermost portion of said glaze.

2. A thermal head according to claim 1, wherein a curvature of the outer surface of each of said heater portions is 0.04 $mm^{-1}$ or more.

3. A thermal head according to claim 1, wherein said glaze is formed on only a portion of a surface of said base plate.

4. A thermal head according to claim 1, wherein said glaze is formed on substantially an entire surface of said base plate.

5. A method of manufacturing a thermal head for an image forming device, in which a glaze is formed at at least a portion of a base plate of the thermal head, in which a plurality of heater portions are provided at said glaze, a length of each of said heater portions in an image forming direction of a recording material being less than or equal to 100 $\mu$m, wherein an outer surface of each of said heater portions being a convex curved surface and the outermost portion of said glaze, comprising the step of:

lapping the outer surface of said glaze a plurality of times and under different conditions.

6. A method of manufacturing a thermal head according to claim 5, further comprising the step of:

using an image forming device in which said glaze is equipped with the thermal head and a toner ribbon are slidable, wherein the toner ribbon is replaced with a lapping tape, and the outer surface of said glaze is lapped by sliding the outer surface of said glaze and the lapping tape.

7. A method of manufacturing a thermal head according to claim 6, wherein the lapping tape is slid in the image forming direction of a recording material and the outer surface of said glaze is lapped at two different lapping positions.

8. A method of manufacturing a thermal head according to claim 7, wherein the two different lapping positions are determined by changing the relative positions of the thermal head and a platen.

9. A method of manufacturing a thermal head according to claim 8, wherein the relative positions of the thermal head and the platen for determining the one of the two different lapping positions is a position at which an image is formed on the recording material.

10. A method of manufacturing a thermal head according to claim 9, wherein the relative positions of the thermal head and the platen for determining the other of the two different lapping positions is determined by disposing the spacer, which can change the relative positions of the thermal head and the platen, at a predetermined positioning portion.

11. A method of manufacturing a thermal head according to claim 10, wherein said predetermined positioning portion is a bearing portion of the platen.

12. A method of manufacturing a thermal head according to claim 10, wherein the spacer is substantially U-shaped.

13. A method of manufacturing a thermal head according to claim 7, wherein the two different lapping positions are determined by changing the position of the thermal head.

14. A method of manufacturing a thermal head according to claim 13, wherein the position of the thermal head for determining one of the two different lapping positions is a position at which an image is formed on a recording material.

15. A method of manufacturing a thermal head according to claim 14, wherein the position of the thermal head for determining the other of the two different lapping positions is determined by disposing a spacer, which can change the position of the thermal head, at a predetermined positioning portion.

16. A method of manufacturing a thermal head according to claim 15, wherein said predetermined positioning portion is a bearing portion of a platen.

17. A method of manufacturing a thermal head according to claim 6, wherein the lapping tape is slid in the image forming direction of the recording material and in the direction opposite of the image forming direction of the recording material and the outer surface of said glaze is lapped at the same lapping position.

18. A method of manufacturing a thermal head according to claim 17, wherein the position of the thermal head for determining said same lapping position is a position at which an image is formed on the recording material.

19. A heat-sensitive recording method, comprising the step of:

recording, onto a heat-sensitive recording material which has an ink layer having a film thickness of 1.0 $\mu$m or less, by a thermal head having a base plate on which a glaze is formed, said glaze having a heater portion with a convex curved surface having a curvature of 0.04 $mm^{-1}$ or more that forms an outermost portion of said glaze.

20. A heat-sensitive recording method according to claim 19, wherein the heat-sensitive recording material includes pigment having 30 to 70 parts by weight and amorphous organic polymer having 25 to 60 parts by weight and softening point of 40° C. to 150° C., the heat-sensitive recording material has a substantially transparent heat-sensitive ink layer with a film thickness in the range of 0.2 $\mu$m to 1.0 $\mu$m, the particle diameter of 70% or more of the pigment within the heat-sensitive ink layer is 1.0 $\mu$m or less, and the optical reflection density of an image transferred onto a white supporting body is at least 1.0 or more.

21. A thermal head comprising:

a base plate; and a glaze formed on said base plate, said glaze having a heater portion;

wherein said heater portion has a convex curved surface that forms an outermost portion of said glaze; and wherein said convex curved surface has a curvature of 0.04 $mm^{-1}$ or more.

22. The thermal head according to claim 21, wherein said heater portion has a length in an image forming direction that is less than or equal to 100 $\mu$m.

* * * * *